US009540830B2

(12) United States Patent
Rosati

(10) Patent No.: US 9,540,830 B2
(45) Date of Patent: Jan. 10, 2017

(54) BRACKET ASSEMBLY FOR SECUREMENT TO A FORMWORK SUPPORT FOR FORMING AN ELEVATED CONCRETE SLAB

(75) Inventor: Emilio Rosati, New South Wales (AU)

(73) Assignee: Form 700 Pty Ltd, Victoria (AU)

( * ) Notice: Subject to any disclaimer, the term of this patent is extended or adjusted under 35 U.S.C. 154(b) by 190 days.

(21) Appl. No.: 14/128,335

(22) PCT Filed: Jun. 21, 2012

(86) PCT No.: PCT/AU2012/000715

§ 371 (c)(1),
(2), (4) Date: Mar. 27, 2014

(87) PCT Pub. No.: WO2012/174597

PCT Pub. Date: Dec. 27, 2012

(65) Prior Publication Data

US 2014/0223853 A1 Aug. 14, 2014

(30) Foreign Application Priority Data

Jun. 22, 2011 (AU) ..... 2011902438

(51) Int. Cl.

| | |
|---|---|
| ***E04G 11/48*** | (2006.01) |
| ***E04G 11/38*** | (2006.01) |
| ***E04G 17/18*** | (2006.01) |
| ***E04G 17/00*** | (2006.01) |
| ***E04G 17/06*** | (2006.01) |
| ***E04G 21/02*** | (2006.01) |
| ***E04G 17/16*** | (2006.01) |

(52) U.S. Cl.

CPC ..... *E04G 11/486* (2013.01); *E04G 11/38* (2013.01); *E04G 17/001* (2013.01); *E04G 17/06* (2013.01); *E04G 17/16* (2013.01); *E04G 17/18* (2013.01); *E04G 21/02* (2013.01)

(58) Field of Classification Search

CPC ..... E04G 17/001; E04G 17/06; E04G 17/16; E04G 11/38; E04G 11/486; E04G 21/02; E04G 17/18

See application file for complete search history.

(56) References Cited

U.S. PATENT DOCUMENTS

| | | | |
|---|---|---|---|
| 3,294,357 | A | 12/1966 | Tooley |
| 3,954,248 | A | 5/1976 | Barber |

(Continued)

FOREIGN PATENT DOCUMENTS

| | | | |
|---|---|---|---|
| CH | 124 094 | A | 1/1928 |
| CH | 125 864 | A | 5/1928 |

(Continued)

OTHER PUBLICATIONS

International Search Report and Written Opinion for Application No. PCT/AU2012/000715 dated Oct. 2, 2012.

(Continued)

*Primary Examiner* — Michael Safavi
(74) *Attorney, Agent, or Firm* — Alston & Bird LLP

(57) ABSTRACT

This invention relates to a bracket assembly for a hardware assembly for forming an elevated concrete slab or the like, the bracket assembly comprising a body securable to a supporting structure and a load bearing support carriage which depends from the body and is movable between at least upper and lower positions relative to the body while depending therefrom. An associated hardware assembly and method of use thereof are also disclosed.

10 Claims, 10 Drawing Sheets

(56) References Cited

U.S. PATENT DOCUMENTS

| | | | |
|---|---|---|---|
| 4,450,121 | A | 5/1984 | Bequette |
| 2008/0031686 | A1 | 2/2008 | Gillespie et al. |

FOREIGN PATENT DOCUMENTS

| | | | |
|---|---|---|---|
| DE | 155308 | C | 11/1904 |
| FR | 1 215 354 | A | 4/1960 |
| FR | 2 852 342 | A1 | 9/2004 |
| GB | 582027 | A | 11/1946 |
| GB | 1 255 508 | A | 12/1971 |
| GR | 95 100 447 | A | 8/1997 |
| JP | S59-15169 | A | 1/1984 |
| JP | 10-061178 | A | 3/1998 |
| KR | 10-0777400 | | 11/2007 |
| KR | 10-2011-0003165 | | 1/2012 |
| RU | 2329364 | C2 | 7/2008 |
| SU | 670708 | A | 6/1979 |
| WO | WO 2004/065722 | A1 | 8/2004 |

OTHER PUBLICATIONS

Office Action for Japanese Application No. 2014-516133 dated Jun. 30, 2015.

Office Action for Russian Application No. 2014 101685/03(002516) dated Jun. 16, 2015.

Supplementary European Search Report for Application No. EP 12 80 3337 dated Nov. 5, 2014.

Supplementary European Search Report for Application No. EP 12 80 3337 datd Jan. 9, 2015.

BRACKET ASSEMBLY FOR SECUREMENT TO A FORMWORK SUPPORT FOR FORMING AN ELEVATED CONCRETE SLAB

FIELD OF THE INVENTION

This invention relates to a means for supporting concrete formwork.

PRIORITY

This patent application claims priority from:

Australian Provisional Patent Application No 2011902438, titled "FORMWORK SUPPORT IMPROVEMENTS", and filed on 22 Jun. 2011.

The entire content of this application is hereby incorporated by reference.

BACKGROUND OF THE INVENTION

This invention relates to means and a method for forming elevated concrete slabs, and more particularly, to hardware used in the formation of these slabs, although it is not so limited in application.

In known building practice, formwork is assembled on a surface or on a lower floor level to form the next level of the building above. The formwork includes box forms to create columns, and table forms to form concrete beams and/or floor surfaces extending between the beams.

Table forms are normally held in position by scaffolding. The scaffolding is assembled on to the surface or floor below with the table forms being supported on the scaffolding. The table forms are lowered into position on to the scaffolding by cranes.

The table forms normally have plywood surfaces against which the concrete is poured. A series of joists are spaced along the underneath surface of the plywood and further bearers are located under the joists which locate on the scaffolding to support the formwork.

The scaffolding is strong enough to support concrete which is then poured on to the formwork to create the next floor above. Once this concrete is set, and becomes self-supporting, then the scaffolding and formwork can be removed from beneath.

Normally, scissor lift mechanisms or platforms are used to support the table forms while the scaffolding is removed. The table form formwork is then prised away from the concrete surface and lowered to ground level. All the components are stacked for the removal from the building site by forklift and crane.

The objects and advantages of the present invention will become apparent from the following description, taken in connection with the accompanying drawings, wherein, by way of illustration and example, an embodiment of the present invention is disclosed.

SUMMARY OF THE INVENTION

In one aspect, the invention may be said to reside in a bracket assembly for a hardware assembly for forming an elevated concrete slab or the like, the bracket assembly comprising a body shaped like a u-shaped saddle which is sized and adapted to seat over a supporting structure, the body comprising a first plate like side portion space apart form a second plate-like side portion, and a bridging portion connecting the first and second side portions, and each side portion terminating in a hinge connected to a support carriage, each hinge extending along a transverse edge of a respective side portion that is distal to the bridging portion, each hinge pivoting about an axis in line with the transverse edge of the respective side portion, each support carriage being pivotable between at least an upper position and a lower position relative to the body whilst depending therefrom, wherein each support carriage is adjacent an outwardly directed face of its respective side portion when in the upper position, wherein each support carriage is releasably securable in the upper position, and wherein each support carriage comprises a flange positioned at an end distal to the hinge, each flange extending outwardly and away from the bridging portion when the respective support carriage is in the upper position, each flange thereby being configured to support formwork for concrete casting in the upper position only, and in the lower position, each support carriage hangs down from its respective hinge so that each carriage is spaced apart from the upper position and from the slab that the formwork can be separated from the slab, and in use, after the concrete slab has been formed each support carriage is configured to be moved from the upper position to the lower position, so that the formwork is configured to be removed without disturbing the hardware assembly, which hardware assembly is configured to remain in place to support the concrete slab until the concrete slab is sufficiently cured as to be self-supporting when the hardware assembly is configured to be removed.

In the context of this specification the carriage is a movable part of the bracket that bears the formwork.

In one form, in use, the body supports an infill member and the infill member is adapted to fill a void between the supporting structure and the formwork.

In one form, the formwork comprises a formwork panel. In an alternative, the formwork comprises sheets of material, such as aluminum or plywood sheets for instance.

It will be apparent to a person skilled in the relevant art that the bracket may be employed to support other objects. For instance, it may be employed to support a platform or mezzanine floor or further structural elements (such as beams) supporting the same.

In a further aspect then, the invention may be said to reside in a bracket assembly comprising a body adapted for securement to a supporting structure and a support providing carriage which is movable to provide support at or between at least upper and lower positions relative to the body.

In one form, the body of the bracket assembly is adapted for releasable securement to the formwork supporting structure.

In one form, the formwork supporting structure is a portion of a formwork supporting frame.

In one form, the formwork supporting structure is a beam of the formwork supporting frame.

In one form, the body is shaped like a u-shaped saddle which is sized and adapted to seat over the formwork beam.

In one form, the carriage is slidably attached relative to the body of the bracket so as to be slidable between the first and second positions.

In one form, the carriage is pivotably attached relative to the body so as to be pivotable between the first and second positions.

In one form, the bracket comprises means for releasably securing the carriage in the first position.

In one form, the body comprises a pair of spaced apart side portions connected by a bridging portion.

In one form, the or each carriage is movable relative to one of these side portions.

In one form, the bracket assembly comprises a pair of carriages.

In a further aspect, the invention may be said to reside in an element of formwork supporting structure comprising a carriage which is movable between at least first and second positions relative to the element, wherein in the first position the carriage is adapted to support a formwork panel in place for concrete casting, and in the second position the carriage is spaced apart (i.e. separated) from the first position.

In a further aspect, the invention may be said to reside in a hardware assembly for forming an elevated concrete slab, the hardware assembly comprising a plurality of bearers arranged parallel to each other, at least three joists arranged parallel to each other, the joists supported by the bearers and the joists arranged orthogonally to the bearers, a plurality of the above described brackets spaced apart along each of the joists, where these bracket assemblies support formwork panels for forming an elevated concrete slab, where the formwork panels span a gap between adjacent joists and where each formwork panel is supported at opposing ends by the bracket assemblies on the adjacent and parallel joists, where a top of each formwork panel extends above the joists, and infill members are seated atop the joists and aligned with a length of the joists.

In one form, the support carriage comprises a flange for supporting formwork panels, the flange comprising a recess that is sized so that an edge of each of two formwork panels can locate in the recess and a support carriage can support the two formwork panels.

In a further aspect, the invention may be said to reside in a method for forming an elevated concrete slab using the hardware assembly described above, the method comprising the steps of pouring the slab and allowing this to cure at least somewhat before shifting the carriages of the brackets to their lower positions so that the formwork can be removed without disturbing other slab supporting hardware, which can remain in place to support the slab until such time as this is sufficiently cured as to be self-supporting.

A detailed description of one or more embodiments of the invention is provided below along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention.

The present invention may be practiced according to the claims without some or all of these specific details. For the purpose of clarity, technical material that is known in the technical fields related to the invention has not been described in detail so that the present invention is not unnecessarily obscured.

BRIEF DESCRIPTION OF THE DRAWINGS

For a better understanding of this disclosure it will now be described with respect to one or more exemplary embodiments, which shall be described herein with the assistance of drawings wherein.

In the following description, like reference characters designate like or corresponding parts throughout the several views of the drawings.

DESCRIPTION OF A PREFERRED EMBODIMENT

Figure 1:
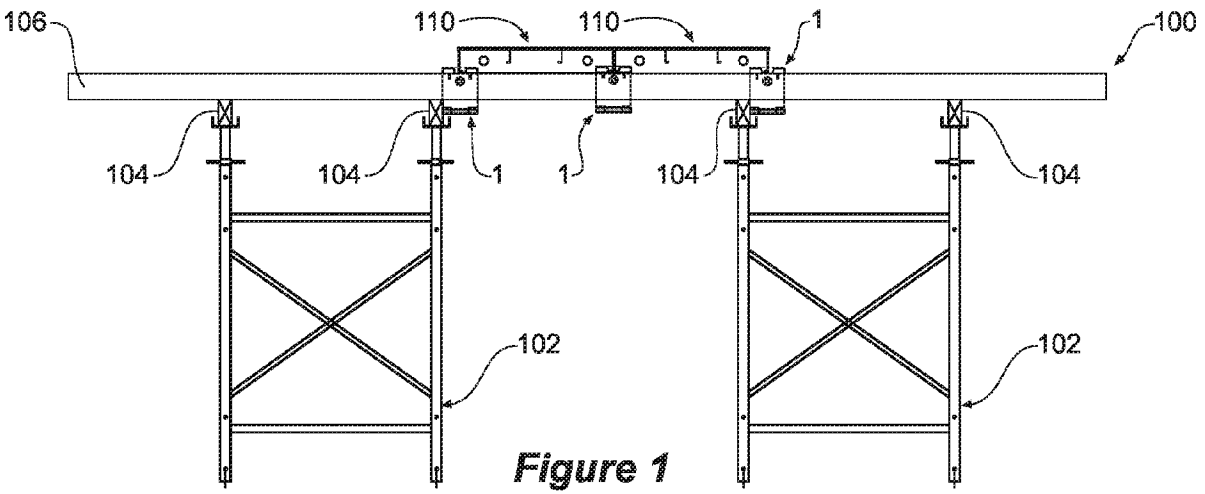
FIG. 1 is a side view of a hardware assembly for forming an elevated concrete slab.
Figure 2:
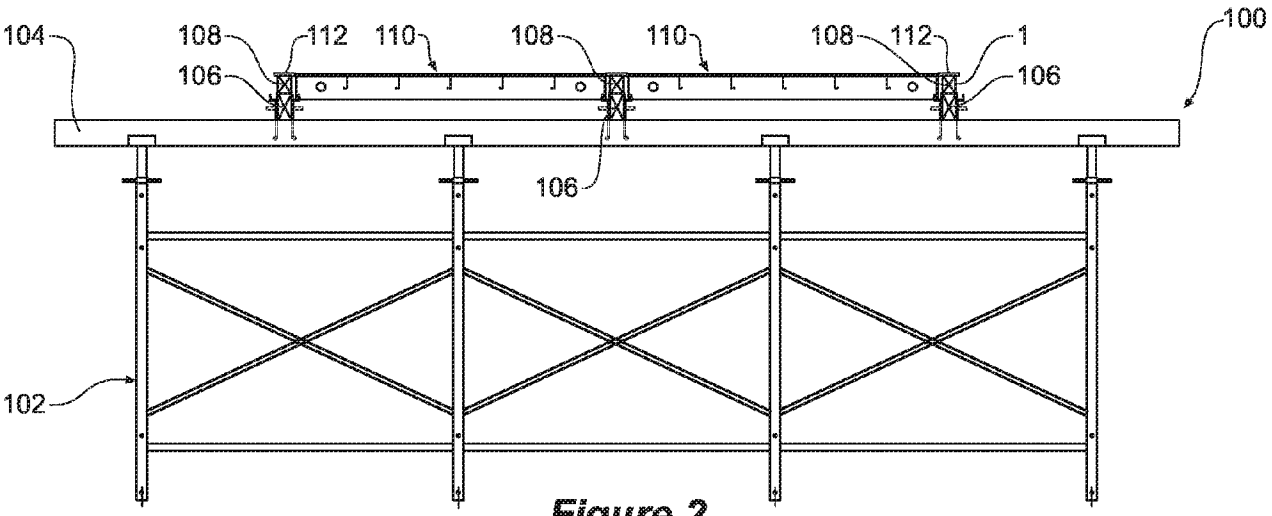
FIG. 2 is an end view of the hardware assembly of FIG. 1.
Figure 3:
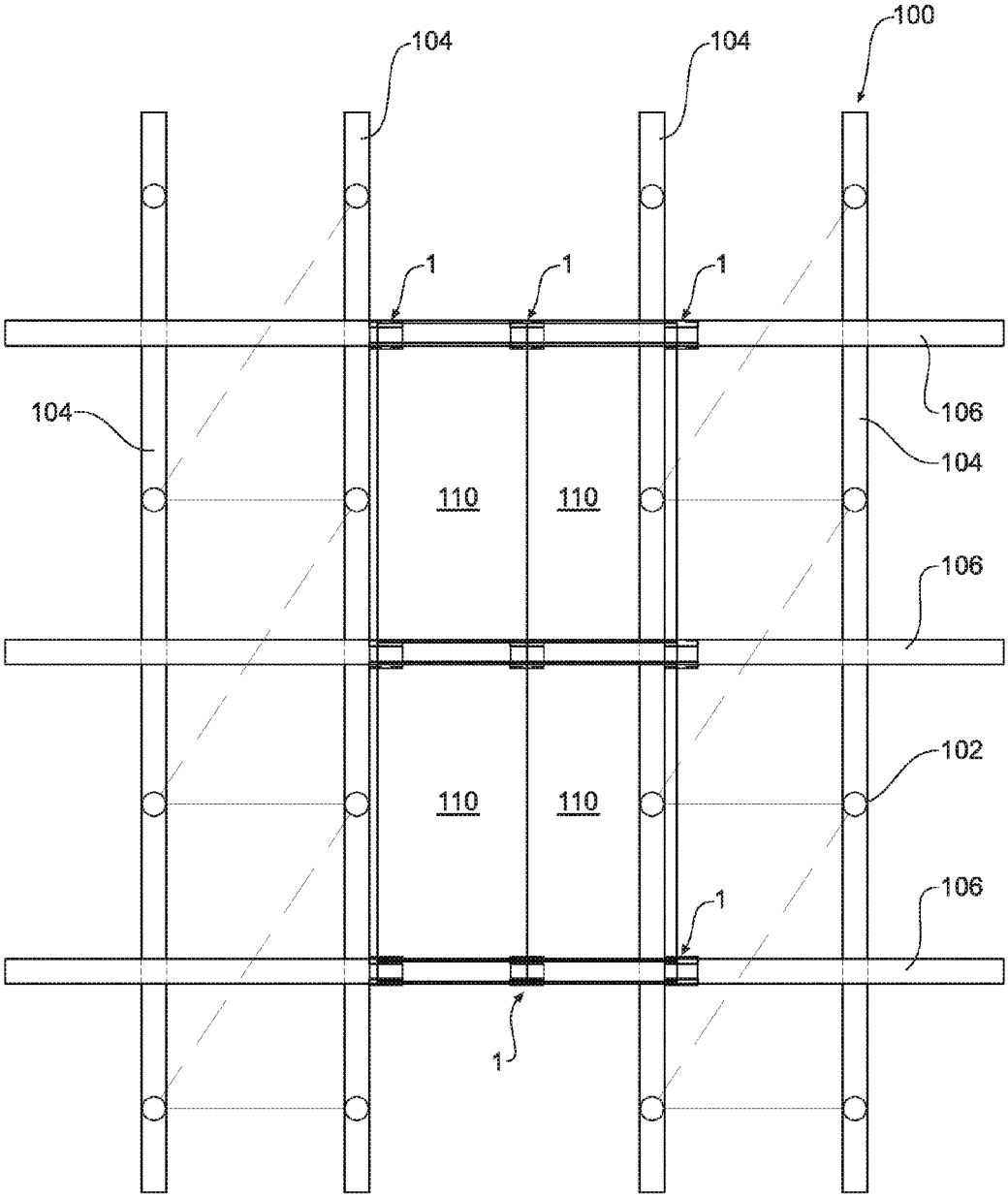
FIG. 3 is a plan view of the hardware assembly of FIG. 1.
Figure 4:
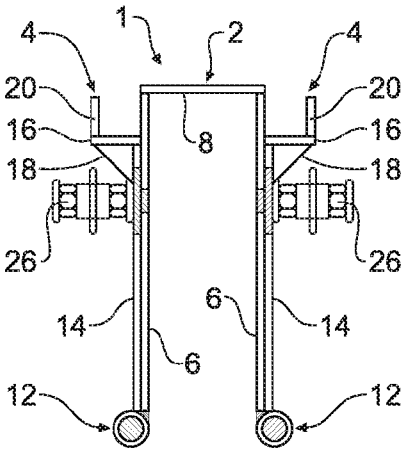
FIG. 4 is an end view of a bracket assembly (from the hardware assembly) according to a first embodiment.
Figure 5:
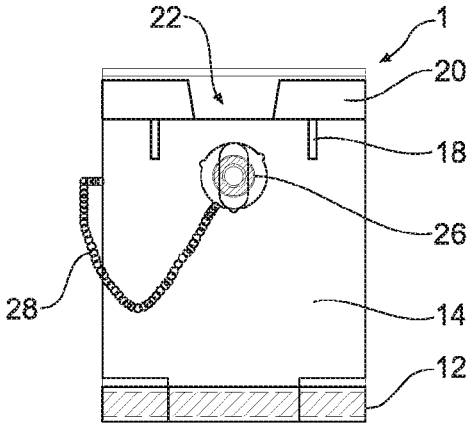
FIG. 5 is a side view of the bracket assembly of FIG. 4.
Figure 6:
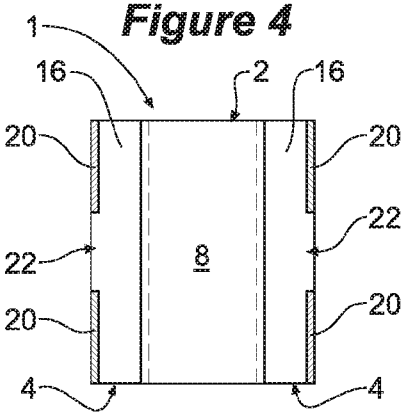
FIG. 6 is a top view of the bracket assembly of FIG. 4.
Figure 7:
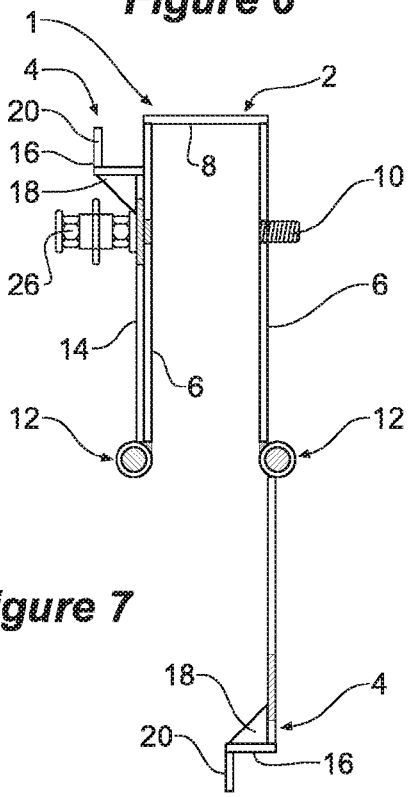
FIG. 7 is an end view of the bracket assembly of FIG. 4, where one of the carriages is shown in its second (i.e. not in use) position.
Figure 8:
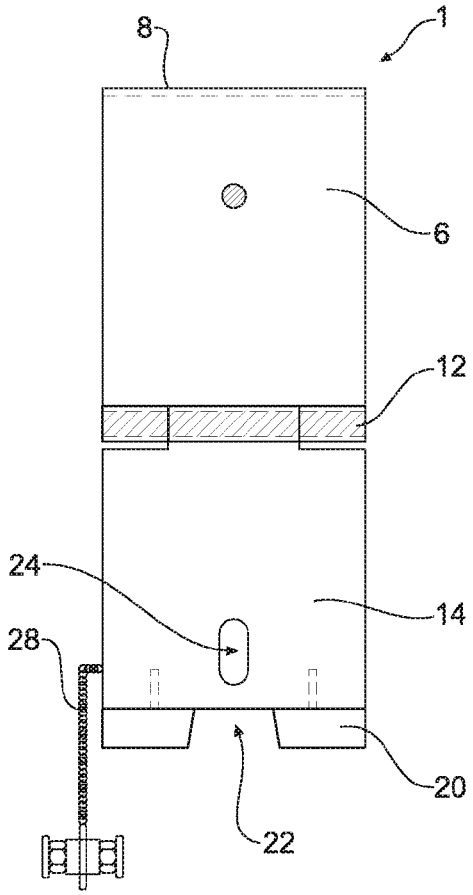
FIG. 8 is a side view of the bracket assembly of FIG. 4, where one of the carriages is shown in its second (i.e. not in use) position.

Referring now to FIGS. 1 through 3, where there is illustrated a hardware assembly 100 for forming an elevated concrete slab, the hardware assembly 100 comprising support frames 102 supporting an array of timber bearers 104, which in turn support an array of timber joists 106 sitting atop of and extending normal to the bearers 104.

The timber joists 106 support an array of brackets 1, and these brackets 1 are adapted to support formwork panels 110, such as for instance, panels of the type sold under the proprietary name 'AIRODECK', or sheets of material, such as aluminium or plywood for instance.

Referring now to FIGS. 4 through 8, each bracket assembly 1 comprises a body 2 adapted for releasable securement to a joist 106 and a carriage 4 which is movable between at least first and second positions relative to the body 2. In the first position (see FIG. 4) the carriage 4 is adapted to support a formwork panel 110 in place for forming the elevated concrete slab, and in the second position (see FIG. 7) the carriage 4 is spaced apart (i.e. separated) from the first position.

The carriage 4 then is a movable part of the bracket assembly 1 that bears the formwork panel 110.

The body 2 of the bracket assembly 1 is shaped like a u-shaped saddle that is sized and adapted to seat over the joist 106. This u-shaped saddle comprises a pair of spaced apart side portions 6 connected by an uppermost bridging portion 8. In use then, the bridging portion 8 of the u-shaped saddle seats over the joist 106 and the side portions 6 extend down opposing sides of the joist 106. A threaded stud 10 extends out from each of the side portions 6 of the bracket assembly 1.

Each of the side portions 6 terminates in a hinge 12 that pivotably connects the carriage 4 to the body 2 so that the carriage 4 can pivot between its first and second positions.

The carriage comprises a plate-like wing 14 which terminates at its outermost end in an outwardly extending flange 16 which is reinforced by a gusset 18. It is on this outwardly extending flange 16 that an edge of the formwork panel 110 will rest when this is supported by the bracket assembly 1. There is an upwardly directed lip 20 extending from an outer edge of the flange 16 which assists to retain the formwork panel 110 on the flange 16. There is a gap 22 in the upwardly directed lip 20 which is sized so that the edges of two panels 110 can locate in this gap 22, and one bracket assembly 1 can support two formwork panels 110.

When in the first position, the carriage wing 14 extends upward and adjacent to the side portion 6 of the bracket body 2 so that the flange 16 is positioned at or about the level of the top of the joist 106. There is an aperture 24 through the wing 14 through which the threaded stud 24 can extend when the carriage wing 14 is in this first position. With the carriage wing 14 in this first position a nut 26 can be screwed onto the threaded stud 10 to releasably secure the carriage wing 14 in place in the first position.

When released and moved to its second position, the carriage wing 14 hangs down from its hinge 12 and the unused nut 26 hangs from a tether 28 that terminates at the wing 14 so that the nut 26 cannot be inadvertently dropped from a height.

Referring once more to FIGS. 1 through 3, where it is illustrated how in use, one or more formwork panels 110 can be suspended between adjacent support frames 102 and a pair of adjacent joists 106 which are in turn supporting brackets 1 that are configured to support the formwork panels 110.

Because the formwork panels 110 have some depth to them, infill beams 108 are seated atop the joists 106 to fill the void that would otherwise exist between the top of the joists 106 and top of the formwork panels 110.

Plywood sheets, strips 112 and timbers can be used to fill any gaps in and around the formwork panels 110 prior to pouring of the concrete slab.

An advantage of these bracket assemblies 1, is that after the concrete slab has been formed the formwork panels 110 can be removed for use elsewhere, without leaving the slab unsupported.

For example, it may be possible to remove the formwork panels 110 three days after pouring the slab, but it may be necessary to leave the remaining slab supporting hardware in place for up to fourteen days after the slab was poured. In this case, the same formwork panels 110 could have been used to form an additional three slabs in the eleven days that pass before the remaining slab supporting hardware is removed. The saving in the number of formwork panels 110 required then is appreciable.

The formwork panels 110 are removed by removing the nut 26 from the threaded stud 10 of the bracket assembly and rotating the carriage wing 14 from its first or in-use position supporting the formwork panel 110, to its second, downward hanging position. The formwork panel 110 can then be lowered between adjacent supporting frames 102 and adjacent supporting joists 106.

Figure 9:
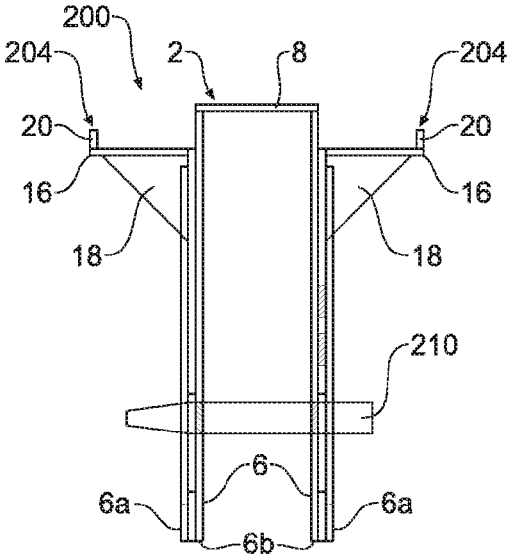
FIG. 9 is an end view of a bracket assembly according to a second embodiment.
Figure 10:
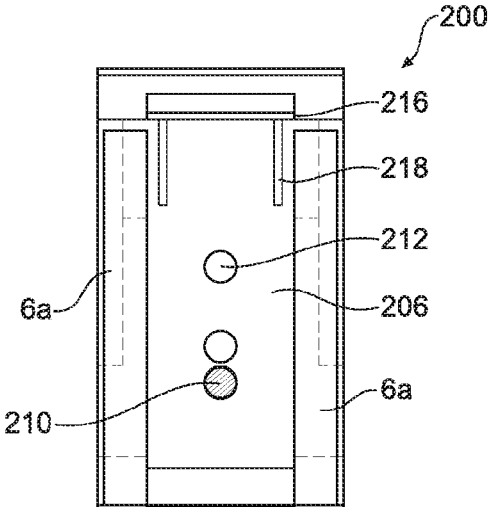
FIG. 10 is a side view of the bracket assembly of FIG. 9.
Figure 11:
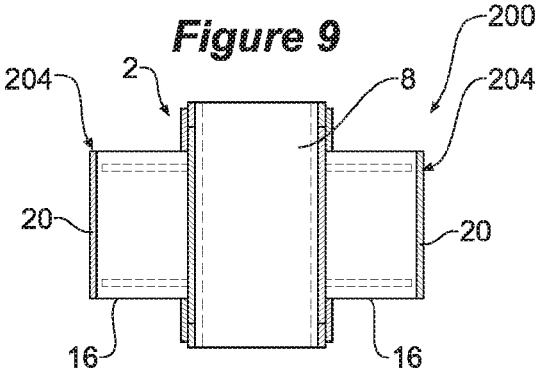
FIG. 11 is a top view of the bracket assembly of FIG. 9.
Figure 12:
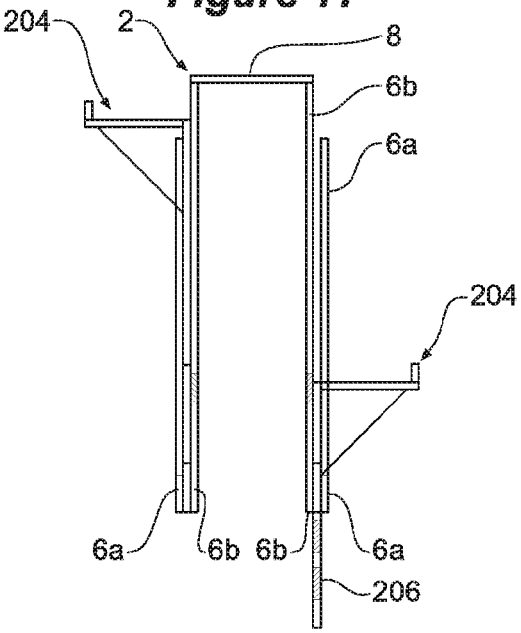
FIG. 12 is an end view of the bracket assembly of FIG. 9, where one of the carriages is shown in its second (i.e. not in use) position.
Figure 13:
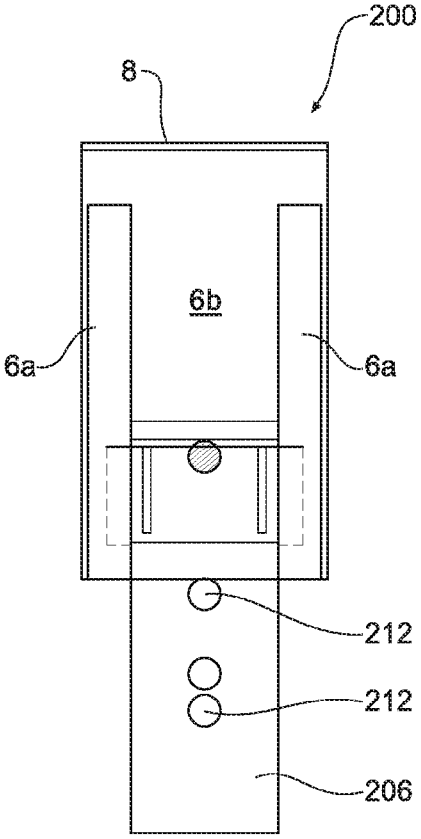
FIG. 13 is a side view of the bracket assembly of FIG. 9, where one of the carriages is shown in its second (i.e. not in use) position.
Figure 14:
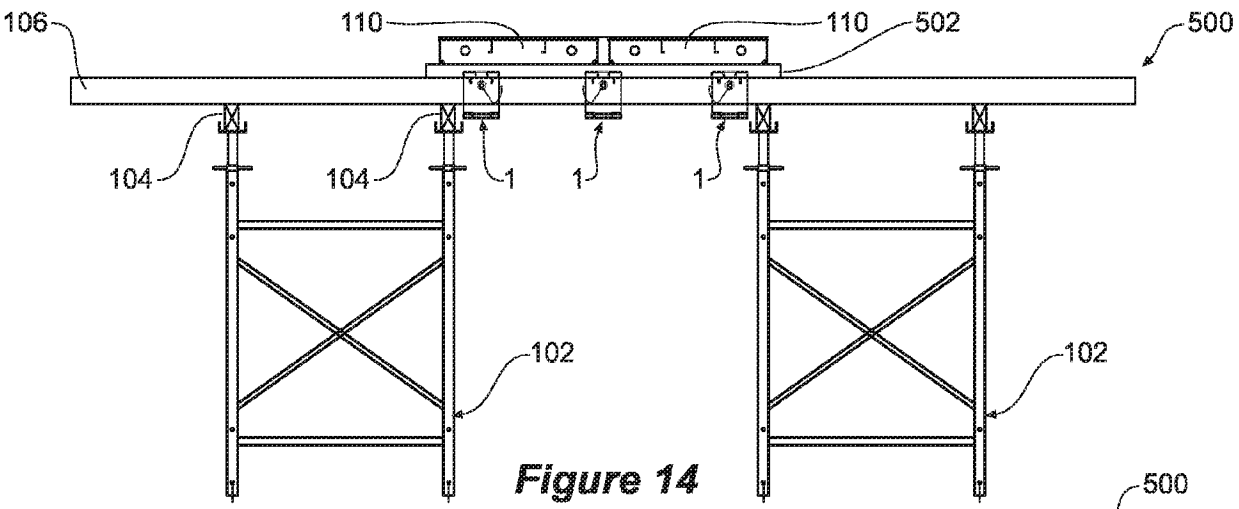
FIG. 14 is a side view of a hardware assembly for forming an elevated concrete slab according to a further embodiment.
Figure 15:
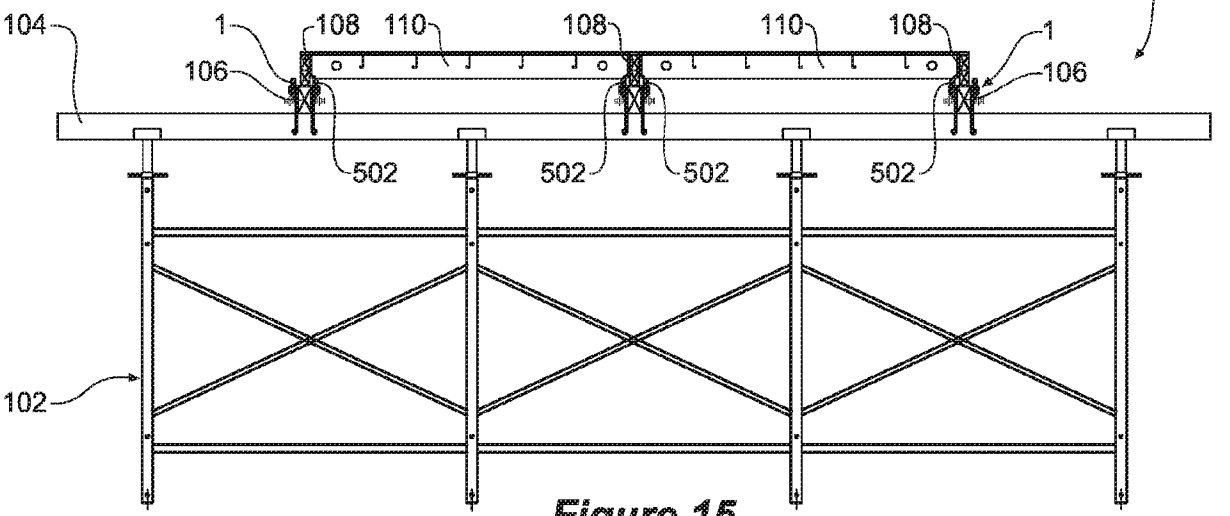
FIG. 15 is an end view of the hardware assembly of FIG. 14.
Figure 16:
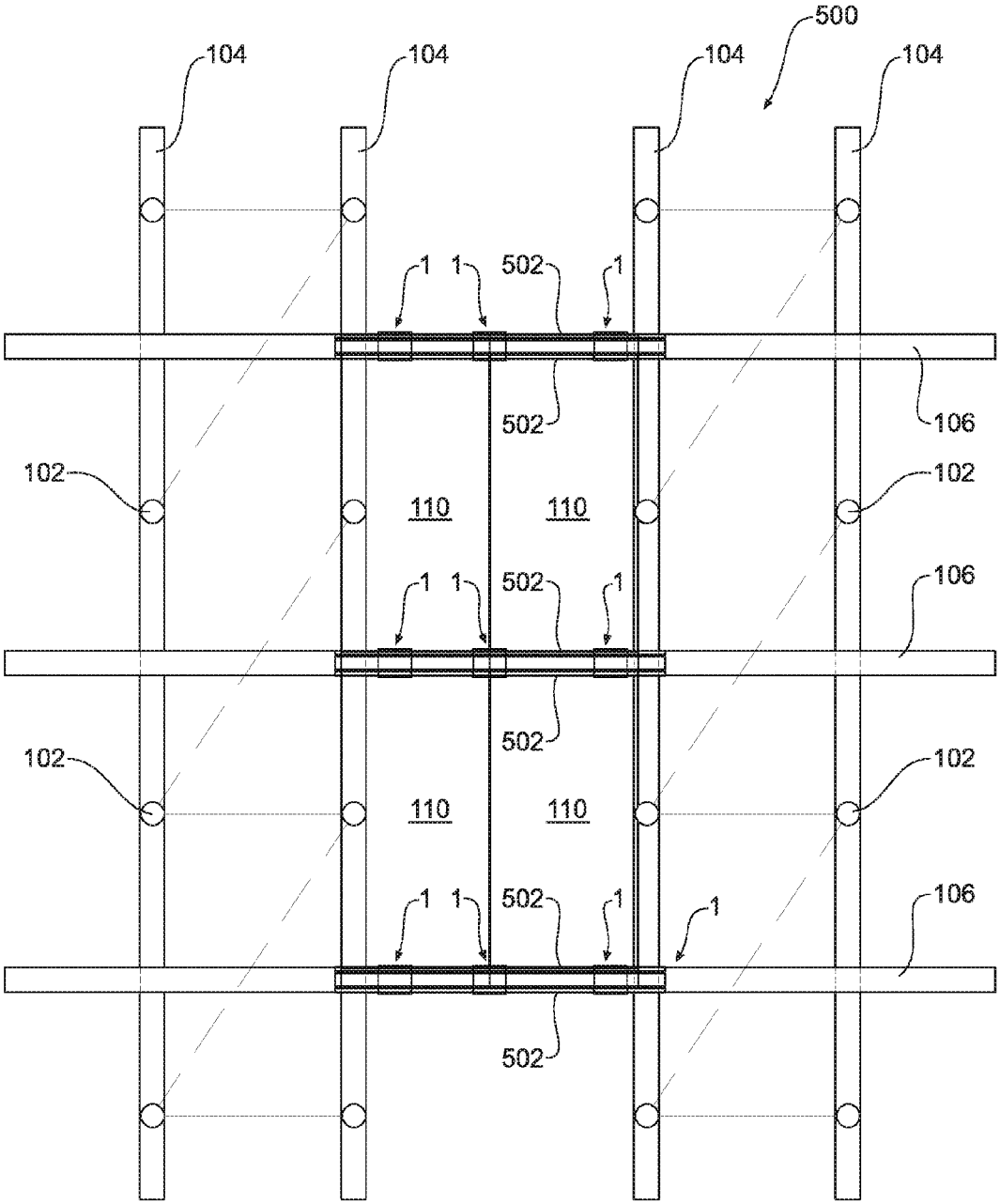
FIG. 16 is a plan view of the hardware assembly of FIG. 14.
Figure 17:
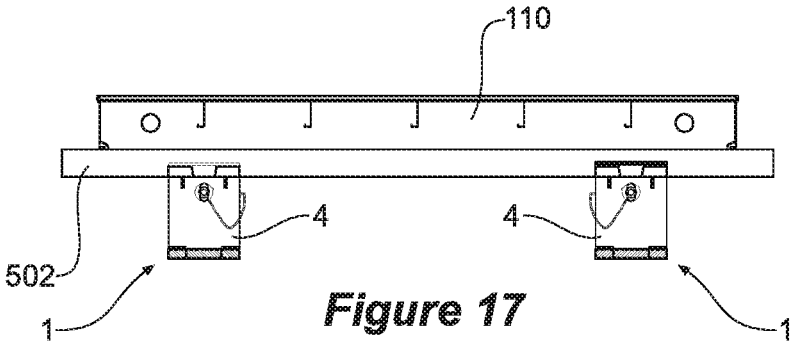
FIG. 17 is a detail side view of the hardware assembly of FIG. 14.
Figure 18:
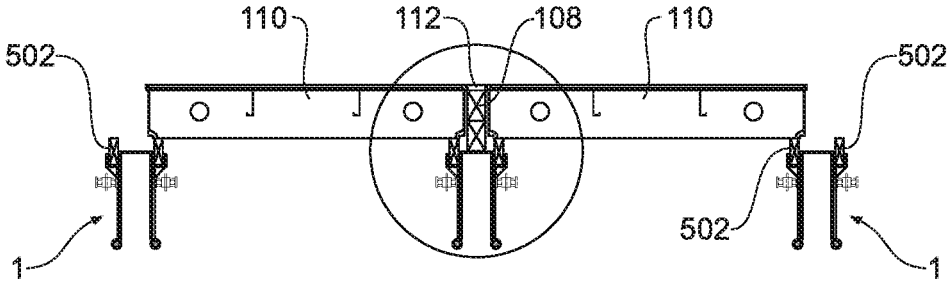
FIG. 18 is a detail end view of the hardware assembly of FIG. 15.
Figure 19:
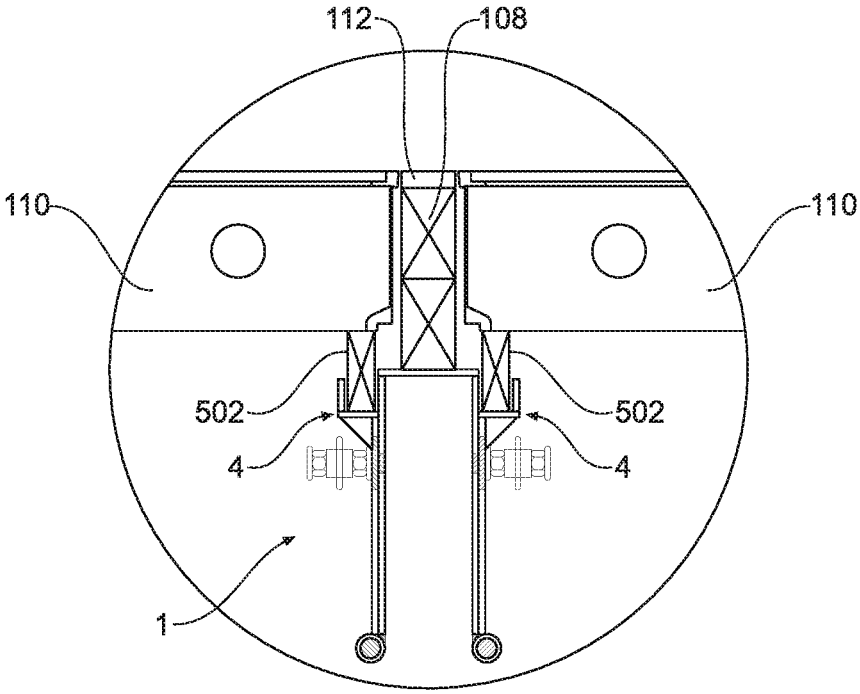
FIG. 19 is a detail view taken at detail 1 of FIG. 17.
Figure 20:
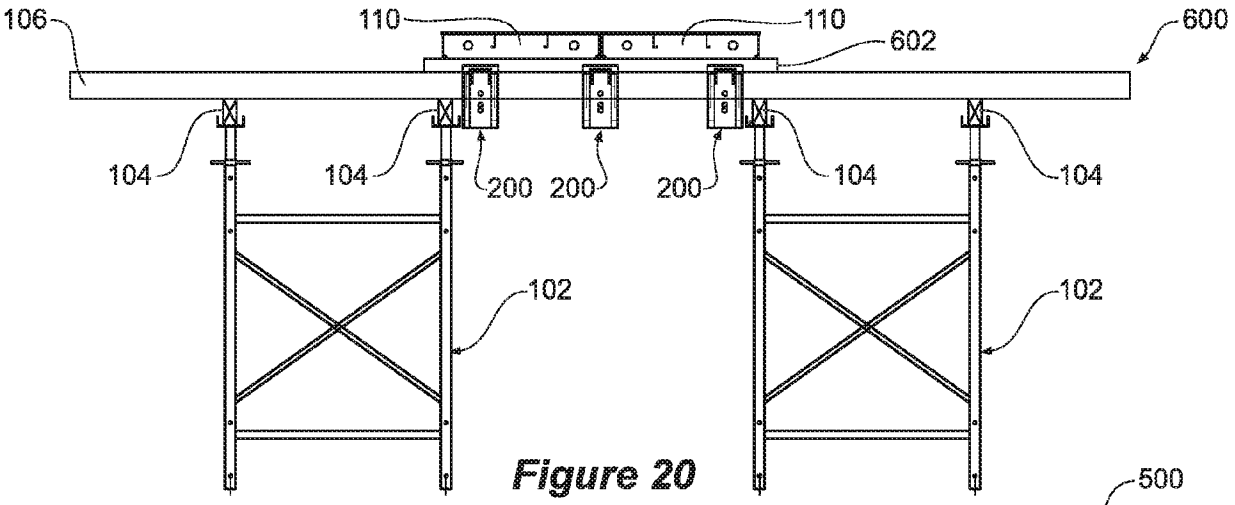
FIG. 20 is a side view of a hardware assembly for forming an elevated concrete slab according to a further embodiment.
Figure 21:
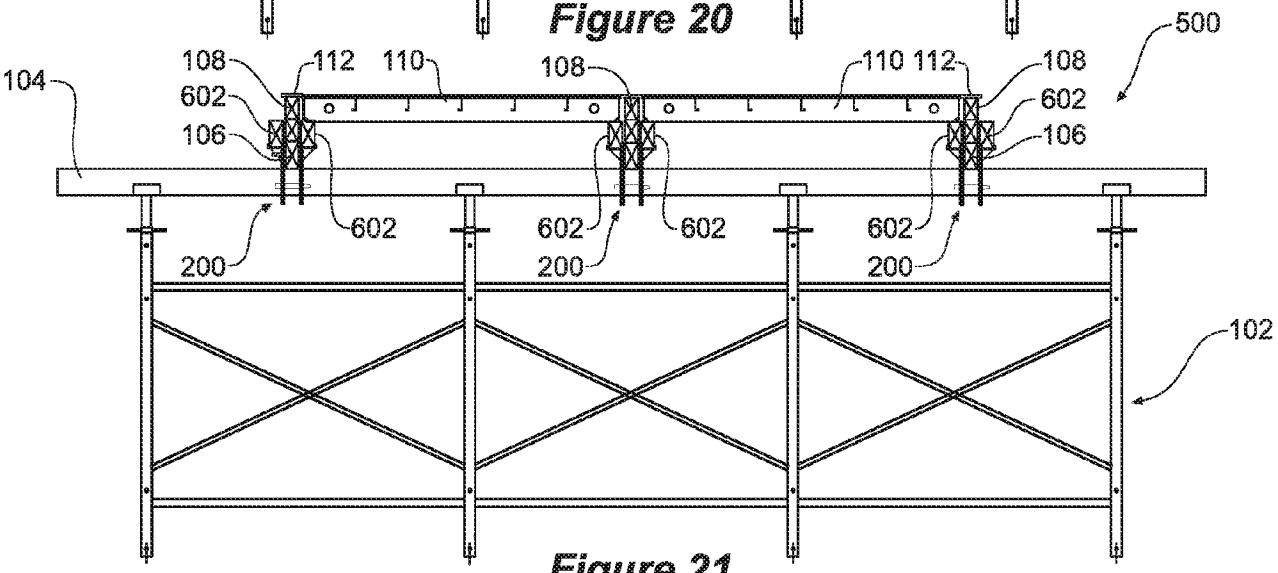
FIG. 21 is an end view of the hardware assembly of FIG. 20.
Figure 22:
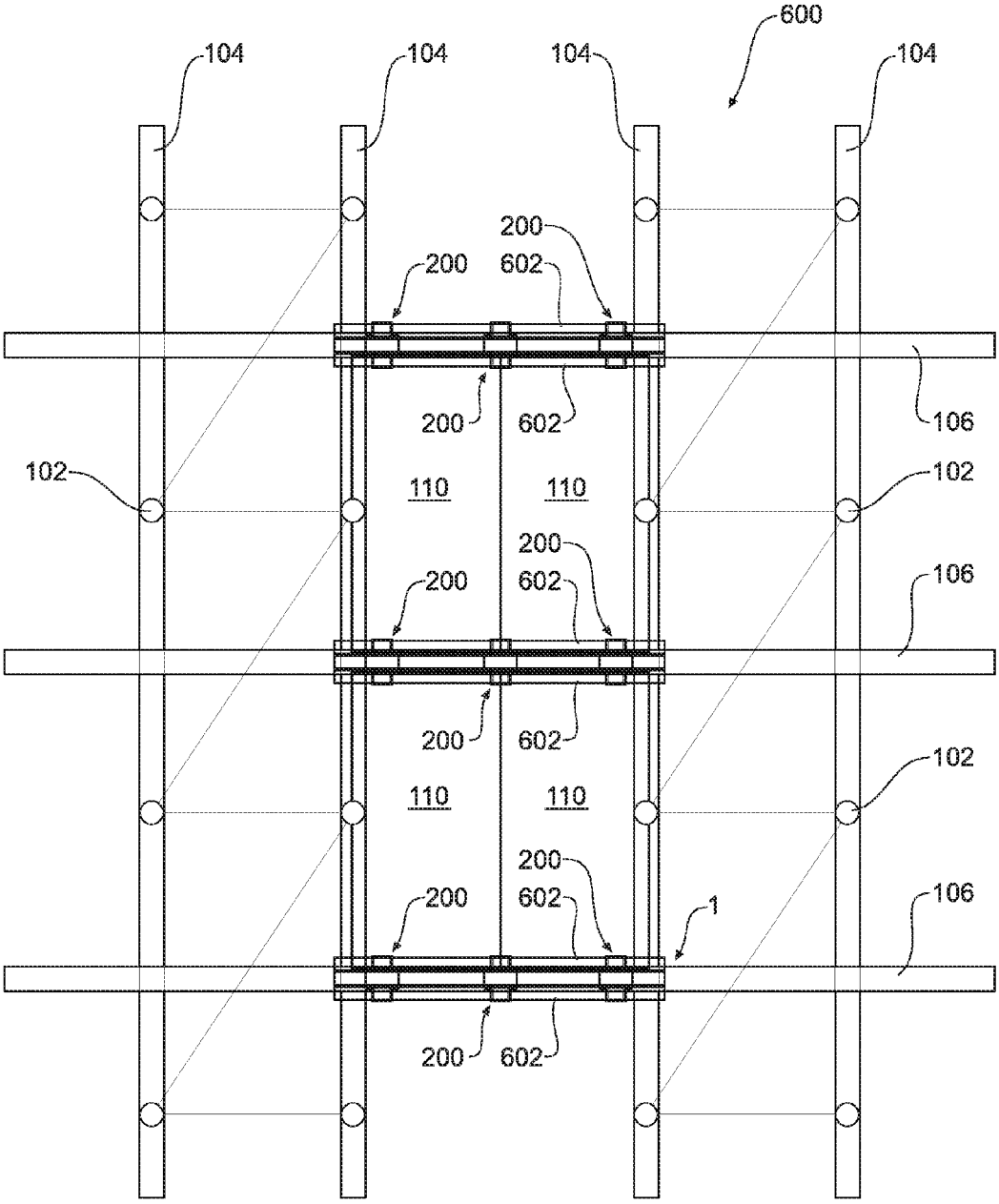
FIG. 22 is a plan view of the hardware of FIG. 20.
Figure 23:
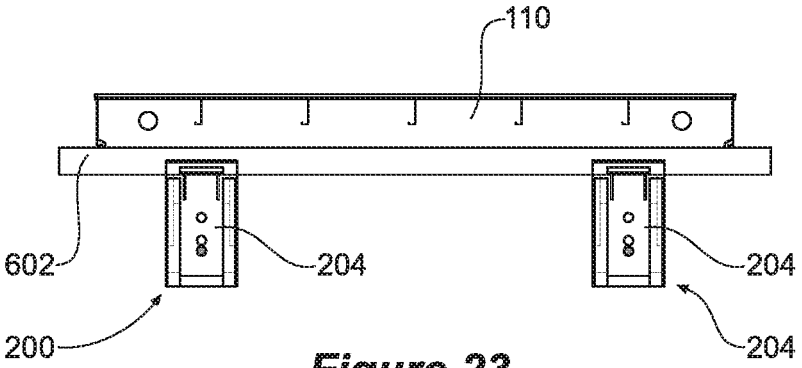
FIG. 23 a detail side view of the hardware assembly of FIG. 20.
Figure 24:
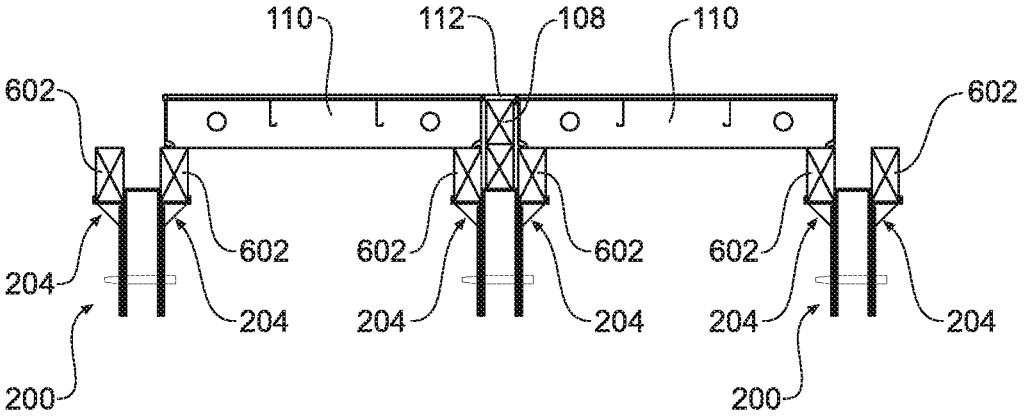
FIG. 24 is a detail end view of the hardware assembly of FIG. 21.

Referring now to FIGS. 9 through 11, where a bracket assembly 200 according to an alternate embodiment is illustrated.

The carriage 204 of bracket assembly 200 is slidably attached relative to the body 202 of the bracket assembly 200 so as to be vertically slidable between the first and second positions.

As was the case with the bracket assembly 1 according to the first embodiment the body 2 of the bracket assembly 200 is shaped like a u-shaped saddle that is sized and adapted to seat over the joist 106. This u-shaped saddle comprises a pair of spaced apart side portions 6 connected by an uppermost bridging portion 8. In use then, the bridging portion 8 of the u-shaped saddle seats over the joist 106 and the side portions 6 extend down opposing sides of the joist 106.

The carriage 204 comprises a plate 206 which terminates at its uppermost end in an outwardly extending flange 16 which is reinforced by a gusset 18.

Each side portion 6 defines a slot-like track between inner portions **6*b* and outer portions 6*a* thereof in which the plate 206 of the carriage 204** is slidably retained.

The carriage 204 can be releasably secured in the first, in use, position by way of a pin 210 passed through aligned apertures 212 in each of the carriage plate, bracket side portions and the joist 106.

As was the case with the bracket 1 according to the first embodiment, after the concrete slab has been formed the formwork panels 110 can be removed for use elsewhere, without disturbing the remaining slab supporting hardware, which can remain in place to support the slab until such time as this is sufficiently cured as to be self-supporting.

The panels are removed by removing the pin 210 and sliding the carriage 204 down from its first or in-use position supporting the formwork panel 110, to its second, lower position. The formwork panel 110 can then be lowered between the adjacent supporting frames 102 and adjacent supporting joists 106.

Where formwork panels could be removed from previous hardware assemblies, the slab was left supported at points only, on the heads of props. An advantage of the system according to the present invention then is that the slab is left supported on continuous beams (joists 106) after the formwork panels are removed. It will be appreciated that a beam can spread the weight of the slab over its length, whereas supporting the slab at points on props creates points of high stress concentration in the slab.

The present invention provides an advantage then in as much the formwork panels 110 can be removed without disturbing the joists 106 that supported the formwork panels 110, meaning these joists 106 remain in position to support the slab whilst this finishes curing, while making the formwork panels 110 available for use elsewhere.

Referring now to FIGS. 14 through 19, where there is illustrated a hardware assembly 500 for forming an elevated concrete slab, which differs from hardware assembly 100 in as much as the carriages 4 of brackets 1 support intermediate beams 502, which in turn support the formwork panels 110.

Referring now to FIGS. 20 through 24, where there is illustrated a hardware assembly 600 for forming an elevated concrete slab, which differs from hardware assembly 500 in as much as the carriages 204 of brackets 200 support intermediate beams 602, which in turn support the formwork panels 110.

Hardware assemblies 500 and 600 offer all of the advantages of hardware assembly 100 discussed above, along with the added benefit that the positioning of the brackets 1 or 200 need not be dictated by the dimensions of the formwork, this being formwork panels 110 in this case, as previously, formwork panels 110 were supported at abutting edges. In this way, it may be possible to support the same number of formwork panels 110 using less brackets 1 or 200.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that various modifications can be made without departing from the principles of the invention. Therefore, the invention should be understood to include all such modifications in its scope.

The invention claimed is:

1. A bracket assembly for a hardware assembly for forming an elevated concrete slab or the like, the bracket assembly comprising a body shaped like a u-shaped saddle which is sized and adapted to seat over a supporting structure, the body comprising a first plate-like side portion spaced apart from a second plate-like side portion, and a bridging portion connecting the first and second side portions, and each side portion terminating in a hinge connected to a support carriage, each hinge extending along a transverse edge of a respective side portion that is distal to the bridging portion, each hinge pivoting about an axis in line with the transverse edge of the respective side portion, each support carriage being pivotable between at least an upper position and a lower position relative to the body whilst depending therefrom, wherein each support carriage is adjacent an outwardly directed face of its respective side portion when in the upper position, wherein each support carriage is releasably securable in the upper position, and wherein each support carriage comprises a flange positioned at an end distal to the hinge, each flange extending outwardly and away from the bridging portion when the respective support carriage is in the upper position, each flange thereby being configured to support formwork for concrete casting in the upper position only, and in the lower position, each support carriage hangs down from its respective hinge so that each carriage is spaced apart from the upper position and from the slab that the formwork can be separated from the slab, and in use, after the concrete slab has been formed each support carriage is configured to be moved from the upper position to the lower position, so that the formwork is configured to be removed without disturbing the hardware assembly, which hardware assembly is configured to remain in place to support the concrete slab until the concrete slab is sufficiently cured as to be self-supporting when the hardware assembly is configured to be removed.

2. The bracket assembly as in claim 1, wherein the supporting structure comprises a portion of a frame or stand.

3. The bracket assembly as in claim 1, wherein the supporting structure or portion thereof is a beam.

4. The bracket assembly of claim 1, wherein the formwork comprises a formwork panel.

5. The bracket assembly of claim 1, wherein the formwork comprises sheets of material, such as aluminum or plywood sheets for instance.

6. The bracket assembly of claim 1, wherein the flange comprises a lip having a recess that is sized so that an edge of each of two adjacent formwork panels can locate in the recess and the support carriage can support the two formwork panels.

7. A hardware assembly for forming an elevated concrete slab, the hardware assembly comprising:

a plurality of bearers arranged parallel to each other;

at least three joists arranged parallel to each other, the joists supported by the bearers and the joists arranged orthogonally to the bearers;

a plurality of the bracket assemblies of claim 1 spaced apart along each of the joists, where these brackets assemblies support formwork panels for forming an elevated concrete slab, where the formwork panels span a gap between adjacent joists and where each formwork panel is supported at opposing ends by the bracket assemblies on the adjacent and parallel joists, where a top of each formwork panel extends above the joists; and infill members are seated atop the joists and aligned with a length of the joist.

8. The hardware assembly of claim 7, wherein in use, the bridging portion of at least one bracket assembly supports an infill member.

9. The hardware assembly of claim 7, wherein the flange of at least one support carriage comprises a lip having a recess, and wherein an edge of each of two adjacent formwork panels are located in the recess and the support carriage supports the two formwork panels.

10. A method for forming an elevated concrete slab using the hardware assembly of claim 7, the method comprising the steps of pouring the concrete slab and allowing the concrete slab to cure at least somewhat before shifting the carriages of the bracket assemblies to their lower positions so that the formwork panels can be removed without disturbing the bearers, joists and infill members, which can remain in place to support the concrete slab until such time as the concrete slab is sufficiently cured as to be self-supporting.

* * * * *